US007401560B2

(12) United States Patent
McCrary

(10) Patent No.: US 7,401,560 B2
(45) Date of Patent: Jul. 22, 2008

(54) RUNNING BOARDS FOR RAILWAY CARS

(75) Inventor: Terry A. McCrary, Pinckneyville, IL (US)

(73) Assignee: GS Metals Corp., Pinckneyville, IL (US)

( * ) Notice: Subject to any disclaimer, the term of this patent is extended or adjusted under 35 U.S.C. 154(b) by 256 days.

(21) Appl. No.: 11/132,775

(22) Filed: May 19, 2005

(65) Prior Publication Data

US 2006/0260504 A1 Nov. 23, 2006

(51) Int. Cl.
*B61C 17/04* (2006.01)

(52) U.S. Cl. ..... 105/457

(58) Field of Classification Search ..... 105/443, 105/448, 450, 460, 457
See application file for complete search history.

(56) References Cited

U.S. PATENT DOCUMENTS

| | | | | |
|---|---|---|---|---|
| 937,415 | A | 10/1909 | Cairns | |
| 1,732,994 | A | 10/1929 | Spiro | |
| 1,780,318 | A | 11/1930 | Snyder | |
| 1,889,605 | A | 11/1932 | Jones | |
| 2,278,554 | A | 4/1942 | Morton | |
| 2,279,756 | A | 4/1942 | Lieberman | |
| 2,401,401 | A | 6/1946 | Bartsch | |
| 3,181,440 | A * | 5/1965 | Mullaney et al. | 105/457 |
| 4,257,620 | A | 3/1981 | Okland | |
| 4,718,353 | A | 1/1988 | Schuller et al. | |
| 4,749,191 | A | 6/1988 | Gipson et al. | |
| 5,286,049 | A | 2/1994 | Khan | |
| 5,423,269 | A | 6/1995 | Saxton et al. | |
| 6,164,210 | A * | 12/2000 | Coslovi et al. | 105/396 |
| 6,520,523 | B2 | 2/2003 | Beck | |
| 6,592,135 | B2 | 7/2003 | Hendrix | |

* cited by examiner

*Primary Examiner*—S. Joseph Morano
*Assistant Examiner*—Robert J McCarry, Jr.
(74) *Attorney, Agent, or Firm*—DLA Piper US LLP; R. Blake Johnston

(57) ABSTRACT

A running board for railway car features a plank and a support where the support is constructed of a steel that is thicker than the steel of the plank. The support features flanges with mounting holes by which it is mounted to the railway car. As a result, the lives of the mounting areas of the support match the life of the plank so that the life of the running board is extended. The plank features side vertical and horizontal lip portions that extend from opposite side edges of the plank's anti-slip walkway. The horizontal lip portions are engaged by tabs formed in the support so that the plank is securely held to the support.

15 Claims, 3 Drawing Sheets

RUNNING BOARDS FOR RAILWAY CARS

BACKGROUND OF THE INVENTION

The present invention relates generally to running boards for railway cars and, more specifically, to running boards that feature an improved construction and mounting arrangement.

Railway freight cars, such as box cars and hopper cars, typically feature a network of running boards mounted thereto that form walkways for navigation by workers. The running boards typically are constructed of steel and are formed with a grid portion so as to provide an anti-slip walking surface. The grid portions of the running boards also provide draft vents for the deflection of snow and discharge openings for the drainage of water.

The running boards may be mounted to the tops of the freight cars or along the fronts, backs and/or sides of the cars. Mounting is typically accomplished via brackets which are secured to the freight cars. The running boards are then typically secured to the brackets via bolts that pass through mounting holes formed in the running boards and nuts. The openings may be formed in the grid portion of the running board, as illustrated in U.S. Pat. No. 1,889,605 to Jones, or in the side portions or grid portion borders of the running boards, as illustrated in U.S. Pat. No. 9,374,15 to Cairns. The openings may also be formed in both the grid portions and the sides or borders, as illustrated in U.S. Pat. No. 1,085,196 to Downing.

Prior art running boards, however, are usually replaced due to cracks or the wearing out of a small amount of material around the mounting holes. When this occurs, the running boards are removed and scrapped. As a result, the lifespan of prior art running boards is severely limited by their mounting areas, that is, the material around the mounting holes. The thickness of the steel around the mounting areas may be increased by increasing the thickness of the running board steel panels overall. This solution, however, is impractical as it results in running boards that are heavy and costly.

A need therefore exists for running boards featuring a construction and design where the mounting area is better matched to the life of the remaining portion of the running board.

Accordingly, it is an object of the present invention to provide a running board for railway cars having mounting areas with thicker material so that they are better matched to the life of the remaining portion of the running board.

It is another object of the present invention to provide a running board that is economical to produce.

It is another object of the present invention to provide a running board that may be securely fastened to a railway car.

It is still another object of the present invention to provide a running board that is easy to install.

These and other objects and advantages will be apparent from the following specification.

SUMMARY OF THE INVENTION

The present invention is a running board for railway cars and other vehicles and includes a plank featuring a walking surface with a pair of side portions positioned one each on opposing side edges of the walking surface. The plank features a grid portion that defines the walking surface of the plank. The plank side portions each features a vertical lip portion and a horizontal lip portion so that each side portion of the plank features a generally C-shaped cross section. The running board also includes a support featuring a bridge portion and a pair of flange portions positioned one each on opposite ends of the bridge portion. A pair of tabs are positioned one each between opposite ends of the bridge portion and the flanges. The tabs are bent so as to engage the horizontal lip portions of the side portions of the plank so that the plank is secured to the support.

The plank is constructed of a material that is thinner than the material of the support. Both the plank and support are preferably constructed of galvanized steel. The flanges of the support each features a mounting hole by which the running board may be mounted to the railway car. As a result, the mounting area of the running board features thicker material than the plank so that the life of the running board is extended.

The following detailed description of embodiments of the invention, taken in conjunction with the appended claims and accompanying drawings, provide a more complete understanding of the nature and scope of the invention.

BRIEF DESCRIPTION OF THE DRAWINGS

FIG. 1AA is a top plan view of another plank suitable for use in the running board of the present invention and featuring an alternative grid design;

DESCRIPTION OF THE PREFERRED EMBODIMENTS

Figure 1A:
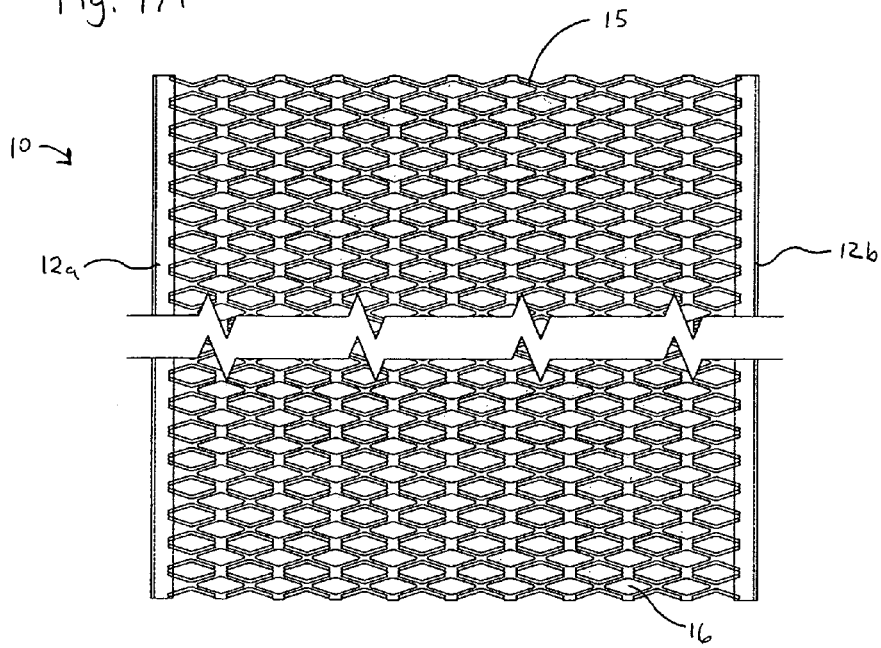
FIG. 1A is a top plan view the plank portion of an embodiment of the running board of the present invention.
Figure 1B:
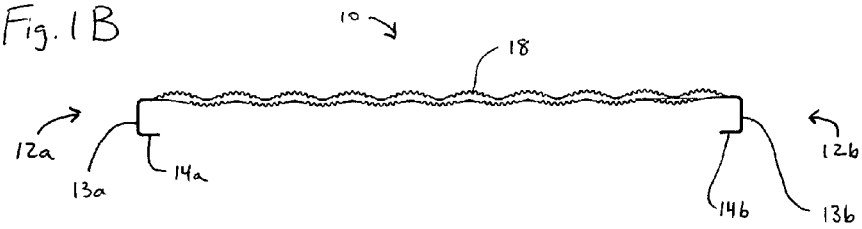
FIG. 1B is a front elevational view of the plank of FIG. 1A.

A plank suitable for use with an embodiment of the running board of the invention is indicated in general at 10 in FIGS. 1A and 1B. The plank is preferably constructed from galvanized steel and features side portions 12*a* and 12*b* that border a grid portion 15. As an example only, the steel may be 14 gage so as to have a thickness of approximately 0.0785 inches. Typical dimensions for the plank portion are around 2 feet wide by 10 feet long.

As illustrated in FIG. 1B, the side portions 12*a* and 12*b* of plank 10 are folded downward and inward so as to form a generally C-shaped cross section featuring vertical and horizontal lip portions 13*a*, 13*b* and 14*a*, 14*b*, respectively.

The grid portion 15 of plank 10 features numerous diamond-shaped openings 16 separated by elements featuring upward-facing serrated or knurled edges 18 that provide an anti-slip walking surface. The grid portion 15 and the side portions 12*a* and 12*b* may all be formed as a single unit or the side portions may be attached to the grid portion such as by welding. It should be noted that the configuration of the grid portion of the plank is not limited to the one illustrated in FIGS. 1A and 1B and that many alternative grid portions known in the prior art are suitable for use. For example, a plank suitable for use in the present invention and featuring an alternative grid design is indicated in general at 11 in FIG. 1AA. Plank 11 features a grid portion 17 that features round openings 18 along with smaller openings 19, each of which feature raised annular portions 20. The remaining portions of plank 11 are the same as plank 10.

Figure 2A:
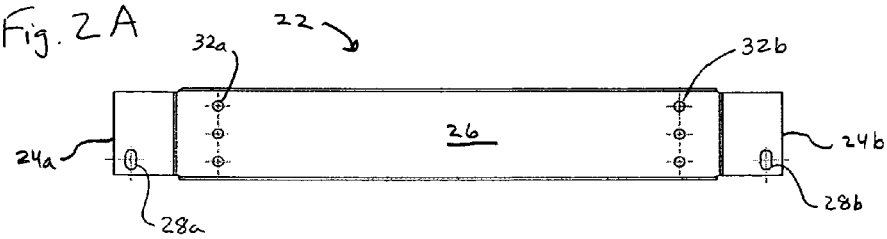
FIG. 2A is a top plan view of the support portion of an embodiment of the running board of the present invention.
Figure 2B:
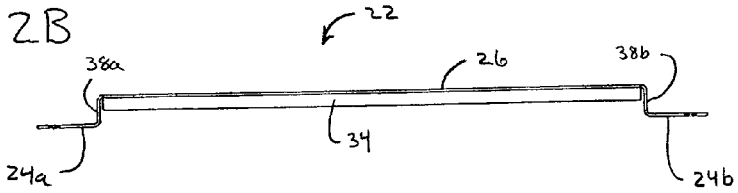
FIG. 2B is a front elevational view of the support of FIG. 2A.
Figure 2C:
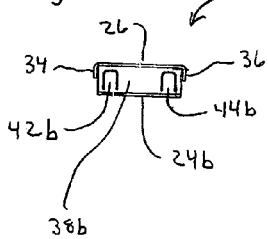
FIG. 2C is a side elevational view of the support of FIGS. 2A and 2B.
Figure 1A:
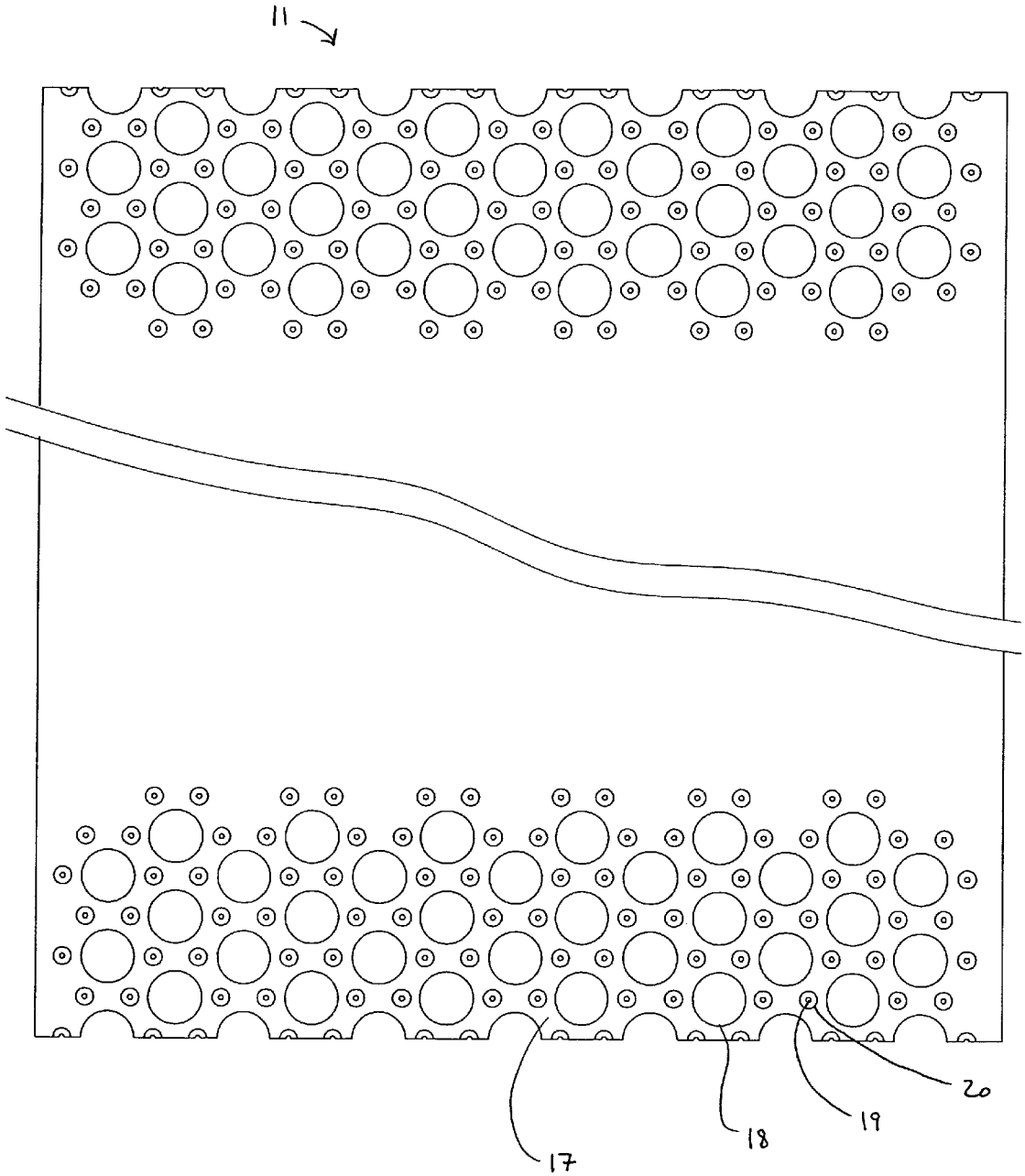

FIGS. 2A-2C illustrate a support, indicted in general at 22, that may be used with an embodiment of the running board of the present invention. The support preferably is constructed of galvanized steel. As an example only, the steel may be 12 gage with a thickness of approximately 0.1084 inches. The key consideration is that the thickness of the steel, or other material, of support 22 is thicker than the steel of the plank 10 of FIGS. 1A and 1B. As will be explained below, this provides the running board of the present invention with a longer life span as compared to prior art running boards.

As illustrated in FIGS. 2A and 2B, the support 22 features a pair of flange portions 24*a* and 24*b* that are positioned on opposite ends of a bridge portion 26. Each flange features a mounting hole, as illustrated at 28*a* and 28*b*. The bridge portion 26 is similarly provided with plank mounting holes 32*a* and 32*b*. As illustrated in FIGS. 2B and 2C, the bridge portion features downturned side edges 34 and 36 which improve rigidity. Vertical portions 38*a* and 38*b* are positioned between the bridge portion 26 and the flanges 24*a* and 24*b*. As illustrated for vertical portion 38*b* in FIG. 2C, each vertical portion of the support is provided with a pair of tabs 42*b* and 44*b*. The number of tabs illustrated are as an example only as any number of tabs may alternatively be used.

Figure 3A:
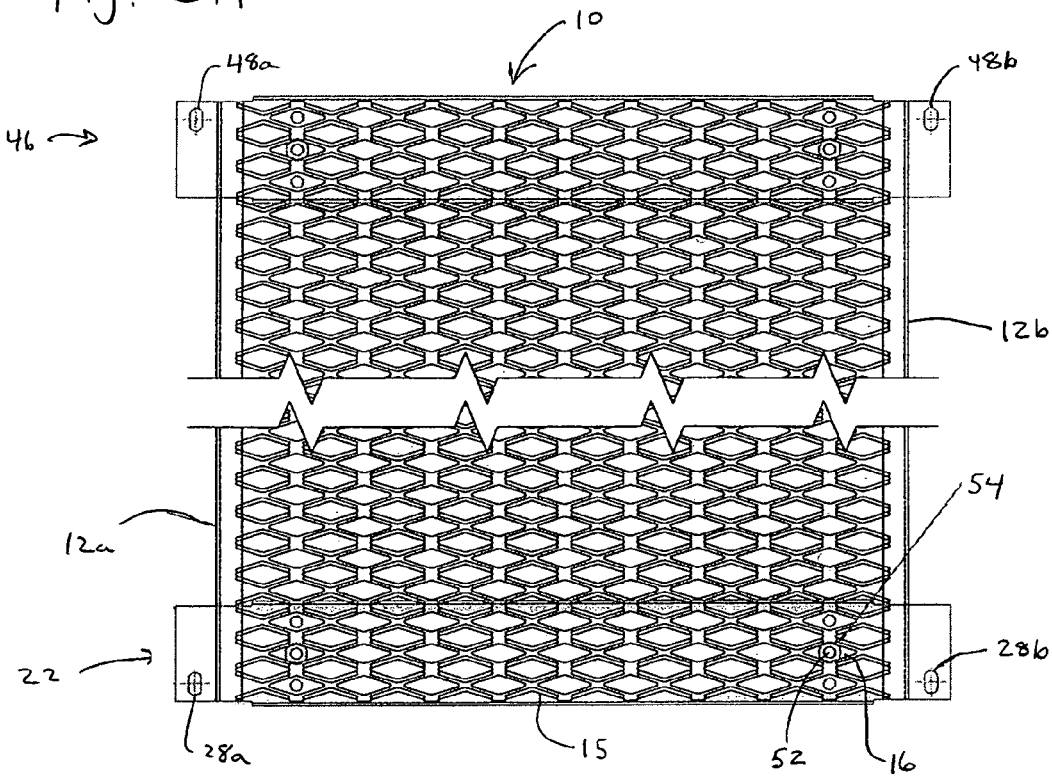
FIG. 3A is a top plan view of an embodiment of the running board of the present invention assembled from the plank of FIGS. 1A and 1B and the support of FIGS. 2A-2C.
Figure 3B:
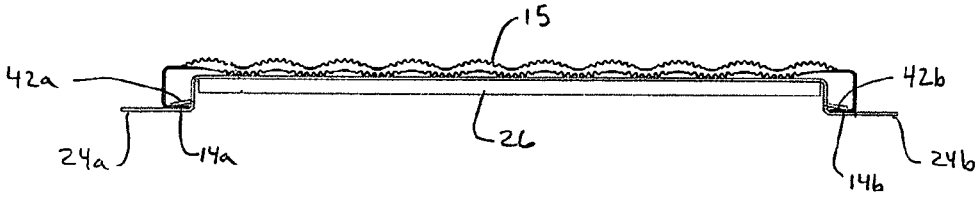
FIG. 3B is a front elevational view of the running board of FIG. 3A.
Figure 3C:
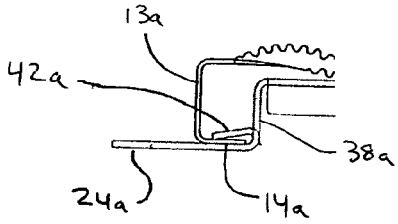
FIG. 3C is an enlarged view of the support tabs of FIG. 3B in the bent or folded configuration so that the support and plank portions of the running board of FIG. 3A are secured together.

FIGS. 3A through 3C show the plank 10 of FIGS. 1A and 1B assembled with the support 22 of FIGS. 2A and 2B. More specifically, the plank 10 is positioned on top of a number of supports 22 and 46 that are spaced to provide the plank with the appropriate level of support. The supports 22 and 46 may be initially mounted to the roof or other portions of a railway car via bolts passing through mounting holes 28*a*, 28*b*, 48*a* and 48*b* with the plank 10 to be attached later or, alternatively, the plank and supports may be assembled before the assembled running board is attached to the railway car.

As illustrated in FIGS. 3B and 3C, the horizontal lip portions 14*a* and 14*b* of the side portions 12*a* and 12*b* of the plank rest on the flanges 24*a* and 24*b* of the support 22. The grid portion 15 of the plank then rests on the bridge portion 26 of the support. Tabs 42*a*, 42*b* and 44*a*, 44*b* are bent down to secure the horizontal lip portions of the plank to the flanges of the support. Positioning the tabs underneath the plank permits them to be covered and protected from damage by the side portions 12*a* and 12*b* of the plank. In addition, as illustrated in FIG. 3A, bolts 52, optionally equipped with washers 54, pass through selected openings 16 of grid portion 15 and engage the plank mounting holes 32*a* and 32*b* (FIG. 2A) of the support via nuts. As a result, the plank is securely fastened to the support.

The running board of the present invention therefore provides thicker steel in the mounting area of the running board, that is, around the mounting holes 28*a*, 28*b*, 48*a* and 48*b* of the supports 22 and 46 of FIG. 3A. This matches the life of the mounting area with the life of the plank portion so that the life of the running board is extended. The present invention accomplishes this without adding excessive weight or cost to the running board.

As described above, the plank and supports of the running boards of the present invention are also securely fastened together with the assistance of the folding tabs of the support and the lip portions of the plank. The design protects the tabs by covering them with the side portions of the plank and permits in-field assembly of the running boards of the present invention on a railway car or the like.

It should be noted that while the running board of the present invention is described above in terms of use on railway car, the running boards could be used on other vehicles like trucks.

While the preferred embodiments of the invention have been shown and described, it will be apparent to those skilled in the art that changes and modifications may be made therein without departing from the spirit of the invention, the scope of which is defined by the appended claims.

What is claimed is:

1. A running board comprising:

a) a plank constructed of first material and featuring a walking surface;

b) a support featuring a bridge portion constructed of a second material that is thicker than the first material of the plank and a pair of flange portions positioned one each on opposite ends of the bridge portion, each of said flange portions featuring a mounting hole;

c) said plank secured to the support so that said plank overlays the bridge portion of the support so that the plank is reinforced by the thicker bridge portion; and d) said plank featuring a pair of side portions positioned on opposite side edges of the grid portion and each side portion features a vertical lip portion and horizontal lip portion and the support features a pair of tabs positioned one each between the flange portions and each end of the bridge portion, said tabs engaging the horizontal lip portions of the plank so that the plank is secured to the support.

2. The running board of claim 1 wherein the plank features a grid portion that defines the walking surface of the plank.

3. The running board of claim 2 wherein the grid portion includes openings and upward facing edges to provide an anti-slip walking surface.

4. The running board of claim 1 wherein the support features a pair of vertical portions positioned one each between opposite ends of the bridge portion and the flanges and the pair of tabs are formed one each in the vertical portions.

5. The running board of claim 1 wherein the side portions of the plank feature a generally C-shaped cross section.

6. The running board of claim 1 wherein the bridge portion of the support features a plank mounting hole and said plank is further secured to the support by a bolt passing through the plank and the plank mounting hole of the support.

7. The running board of claim 1 wherein the first and second materials are steel.

8. A running board comprising:

a) a plank featuring a walking surface and a pair of side portions positioned one each on opposing side edges of the walking surface;

b) a support featuring a bridge portion and a pair of flange portions positioned one each on opposite ends of the bridge portion and a pair of tabs positioned one each between opposite ends of the bridge portion and the flanges, said tabs engaging the side Portions of the plank so that the plank is secured to the support; and c) plank side portions each featuring a vertical lip portion and horizontal lip portion that is engaged by the tabs of the support.

9. The running board of claim 8 wherein the plank is constructed of a material that is thinner than the material of the support.

10. The running board of claim 9 wherein the plank and support are constructed of steel.

11. The running board of claim 8 wherein the plank features a grid portion that defines the walking surface of the plank.

12. The running board of claim 11 wherein the grid portion includes openings and upward facing edges to provide an anti-slip walking surface.

13. The running board of claim 8 wherein each side portion of the plank features a generally C-shaped cross section.

14. A running board comprising:

a) a plank featuring a walking surface and a pair of side portions positioned one each on opposing side edges of the walking surface;

b) a support featuring a bridge portion and a pair of flange portions positioned one each on opposite ends of the bridge portion and a pair of tabs positioned one each between opposite ends of the bridge portion and the flanges, said tabs engaging the side portions of the plank so that the plank is secured to the support; and c) each flange of the support featuring a mounting hole.

15. A running board comprising:

a) a plank featuring a walking surface and a pair of side portions positioned one each on opposing side edges of the walking surface;

b) a support featuring a bridge portion and a pair of flange portions positioned one each on opposite ends of the bridge portion and a pair of tabs positioned one each between opposite ends of the bridge portion and the flanges, said tabs engaging the side portions of the plank so that the plank is secured to the support; and c) the bridge portion of the support featuring a plank mounting hole and said plank is further secured to the support by a bolt passing through the plank and the plank mounting hole of the support.

* * * * *